US008667616B2

(12) United States Patent
Kronenberger

(10) Patent No.: US 8,667,616 B2
(45) Date of Patent: Mar. 11, 2014

(54) ADORNMENT DEFINED USING FRAYED MATERIAL

(76) Inventor: Ronald Kronenberger, Riverwoods, IL (US)

( * ) Notice: Subject to any disclaimer, the term of this patent is extended or adjusted under 35 U.S.C. 154(b) by 1098 days.

(21) Appl. No.: 11/253,037

(22) Filed: Oct. 18, 2005

(65) Prior Publication Data

US 2007/0094773 A1 May 3, 2007

(51) Int. Cl.
*A41D 27/08* (2006.01)

(52) U.S. Cl.
USPC ..... 2/244

(58) Field of Classification Search
USPC ..... 2/209.13, 244, 274, 275; D2/785, 786
See application file for complete search history.

(56) References Cited

U.S. PATENT DOCUMENTS

| | | | | |
|---|---|---|---|---|
| 2,120,687 | A * | 6/1938 | Tarson | 2/244 |
| 5,416,928 | A * | 5/1995 | Koenig | 2/244 |
| 6,883,449 | B2 * | 4/2005 | Burrell et al. | 112/475.19 |
| 2004/0093657 | A1 * | 5/2004 | Erinc | 2/69 |
| 2005/0183647 | A1 * | 8/2005 | Burrell et al. | 112/475.22 |
| 2006/0143790 | A1 * | 7/2006 | Kronenberger | 2/184 |
| 2006/0143791 | A1 * | 7/2006 | Kronenberger | 2/195.1 |
| 2006/0225632 | A1 * | 10/2006 | Pryce | 112/475.01 |

OTHER PUBLICATIONS

Paige, Jenni; I Wanna Quilt! Pattern Company; www.iwannaquilt.com/hints.shtml; www.iwannaquilt.com/iwq212.shtml; Sep. 26, 2001.*

Sew-What's-New; www.sew-whats-new.com/frayapplique.html; Jul. 11, 2000.*

"Reverse Applique." Applique Basics. 2001. Graham Enterprises. Apr. 13, 2009 <http://web.archive.org/web/20010718190016/http://www.qorsite.com/begin/applique.htm>.*

Deneault, Kim. "Raggedy Reverse Applique". HGTV. Apr. 16, 2010 <http://www.hgtv.com/crafting/raggedy-reverse-applique/index.html>. Published Dec. 16, 2004.*

Heber Valley Quilters, "Heber Valley Quilters Blog: worms width and raggedy reverse". Heber Valley Quilters. Apr. 16, 2010 <http://hebervalleyquilters.blogspot.com/2009/11/worms-width-and-raggedy-reverse.html>. Published Nov. 12, 2009.*

Robson, Heather. "How to Make Custom Jeans Appliqued for Children". eHow. Apr. 15, 2010 <http://www.ehow.com/how_6117617_make-custom-jeans-appliqued-children.html>.*

Swanson, Kirsten. "Project Gallery—Frayed Reverse Applique". Embroidery.com. Apr. 15, 2010 <http://www.embroidery.com/CPGView.asp?sid=&EFID=954&sreqxProjectTypeID=4&sreqxProjectPurposeID=6&DocumentID=1643&shopstop=1>.*

* cited by examiner

*Primary Examiner* — Khoa Huynh
*Assistant Examiner* — Sally Haden
(74) *Attorney, Agent, or Firm* — Wood, Phillips, Katz, Clark & Mortimer

(57) ABSTRACT

An adorned article having a first layer with an exposed surface, and adornment on the first layer that is exposed for viewing. The adornment has a first edge with a predetermined shape that is defined on at least one of: a) the first layer; and b) a second layer associated with the first layer. The adornment further has a second edge that is spaced from the first edge. The first and second edges are defined by materials that have a tendency to fray at the first and second edges. The first and second edges are treated to produce visible fraying with strands that are spaced and/or intermingled.

2 Claims, 3 Drawing Sheets

ADORNMENT DEFINED USING FRAYED MATERIAL

BACKGROUND OF THE INVENTION

1. Field of the Invention

This invention relates to adornment, as formed integrally with, or attached to, an article and, more particularly, to adornment that is highlighted by fraying of a material.

2. Background Art

Many different articles, such as apparel items, have cloth layers that are adorned, or used to provide adornment on, exposed surfaces. Cloth, and other similar types of layers, are commonly used to produce adornment in two different manners. The cloth layer may be an integral part of the article, such as an exposed surface on an apparel article. Alternatively, the cloth layer may be separately applied to a substrate layer in a strategic manner to produce the desired visual effect.

In the former case, various different techniques are used to produce the adornment. As just examples, the cloth layer may be dyed or printed, as through a silkscreening process. In an alternative technique, thread may be stitched at the exposed external surface to produce a desired pattern or design.

Separately applied cloth components likewise are offered in a multitude of different forms. The layer may be in the form of a patch that is cut out, or otherwise preformed, as by multiple components. As one example, a patch may consist of a substrate layer having an embroidered surface. A patch may include multiple cloth layers and/or other materials.

Purveyors of consumer goods, particularly in the apparel area, are constantly seeking out new ways to distinguish their products from their competitors'. A common focus of this effort is the adding of unique adornment to these items.

SUMMARY OF THE INVENTION

In one form, the invention is directed to an adorned article having a first layer with an exposed surface and adornment on the first layer that is exposed for viewing. The adornment consists of a first edge with a predetermined shape that is defined on at least one of: a) the first layer; and b) a second layer associated with the first layer. The first edge is defined by a material that has a tendency to fray at the first edge. The at least one of the first layer and second layer is altered at a location spaced from the first edge along a substantial extent of the predetermined shape so that fraying at the first edge is controlled to within a predetermined distance from the first edge. The first edge is treated to produce visible fraying at the first edge along a substantial extent of the predetermined shape.

In one form, the at least one of the first layer and second layer has a second edge coextensive with the first edge and spaced therefrom over at least a portion of the predetermined shape. The location at which the at least one of the first layer and second layer is altered resides between the first and second edges. The second edge is treated to produce visible fraying at the second edge along a substantial extent of the predetermined shape.

In one form, the first and second edges are spaced from each other along a substantial extent of the predetermined shape so that fraying on the first and second edges is spaced by no more than one inch.

In one form, fraying on the first edge can be placed in contact with fraying on the second edge.

The adorned article may be an apparel item, such as a headwear piece.

In one form, the first edge extends continuously to surround a space on the exposed surface.

The first and second edges may each extend continuously to surround a space on the exposed surface.

In one form, the first and second edges are spaced substantially uniformly from each other over substantially the entire extent of the first and second edges around the space that the first and second edges surround.

In one form, at least one of the first layer and second layer is altered at the location spaced from the first edge by at least one line of stitching.

In one form, the predetermined shape is at least one of: a) a word; b) a logo; c) a letter; d) a depiction of: i) a person; ii) a place; or iii) a thing; and e) an object associated with: i) a person; ii) a place; iii) a thing; or iv) an event.

The fraying on each of the first and second edges may be defined by a plurality of projecting strands with a length of less than one half inch.

The at least one of the first layer and second layer may be made from a woven fabric.

In one form, the adorned article is a baseball-style cap with a crown and a rim/bill and the first layer is defined on the crown.

In one form, the fraying on the first and second edges is intermingled.

In one form, the fraying on the first and second edges has a combined width that is less than one half inch.

The invention is further directed to an adorned article having a first layer with an exposed surface, and adornment on the first layer that is exposed for viewing. The adornment has a first edge with a predetermined shape that is defined on at least one of a) the first layer; and b) a second layer associated with the first layer. The adornment further has a second edge that is spaced from the first edge. The first and second edges are defined by materials that have a tendency to fray at the first and second edges. The first and second edges are treated to produce visible fraying with strands that are intermingled.

In one form, the first and second edges are intermingled along a substantial extent of the predetermined shape.

In one form, the predetermined shape is at least one of: a) a word; b) a logo; c) a letter; d) a depiction of i) a person; ii) a place, or iii) a thing; and e) an object associated with: i) a person; ii) a place; iii) a thing; and iv) an event.

The invention is further directed to a method of producing adornment on an article. The method includes the steps of: providing an article; defining at least a first edge with a predetermined shape on a material that has a tendency to fray at the first edge, at an exposed surface of the article; and treating the material to produce controlled fraying at the first edge that is visible at the exposed surface of the article.

The article may be an apparel item, such as a baseball-style cap.

In one form, the step of defining a first edge involves defining a first edge on a first layer that defines an exposed surface of the crown.

In one form, the article has a first layer defining at least a part of the exposed surface on the article and the step of defining a first edge involves defining a first edge on a second layer that over-/underlies the first layer.

The step of defining at least a first edge with the predetermined shape may involve defining at least a first edge with a predetermined recognizable and identifiable shape that is at least one of: a) a word; b) a logo; c) a letter; d) a depiction of: i) a person; ii) a place; or iii) a thing; and e) an identifiable and recognizable object associated with: i) a person; ii) a place; iii) a thing; or iv) an event.

The step of treating the material to produce controlled fraying may involve stitching through the material.

The method may further include the step of defining at least a second cut edge on a material that has the tendency to fray at the second edge at an exposed surface on the crown.

In one form, the material on which the first cut edge is defined is on the first layer and the material on which the second cut edge is defined is on a layer that over-/underlies the first layer.

The step of treating the material may further involve generating a frictional force at the first edge to produce the controlled fraying.

The step of treating the material to produce controlled fraying may involve stitching through the material at a location between the first and second edges.

DETAILED DESCRIPTION OF THE DRAWINGS

Figure 1:
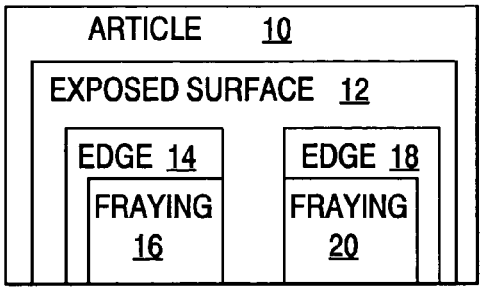
FIG. 1 is a schematic representation of one form of article, adorned according to the present invention, and including two frayed edges.

An adorned article, according to the present invention, is shown schematically at 10 in FIG. 1. The article 10 may be virtually any type of article upon which adornment is conventionally provided, be it functional and/or aesthetic in nature. The invention is particularly adaptable to articles in the form of apparel items, such as shirts, jackets, shoes, hats, etc.

Regardless of the nature of the adorned article 10, the article 10 will have a first layer with an exposed surface 12. The first layer is made from a material that has the tendency to fray at a first edge 14 formed thereon. The nature of the material having this tendency, and usable according to the invention, can vary considerably. Commonly, woven fabric, and the like, falls into this usable category. The edge 14 may be cut and thereafter treated to produce visible fraying 16 at the first edge.

An adjacent, second edge 18 is provided on a layer that consists of a material that likewise has a tendency to fray. The second edge 18 is likewise treated to produce visible fraying 20.

As explained in greater detail below, the invention contemplates that a single edge 14, 18 may be utilized to produce the inventive adornment. As shown in FIG. 1, both edges 14, 18 can be alternatively used to produce a cumulative effect from the fraying 16, 20, that may be spaced or intermingled.

Figure 2:
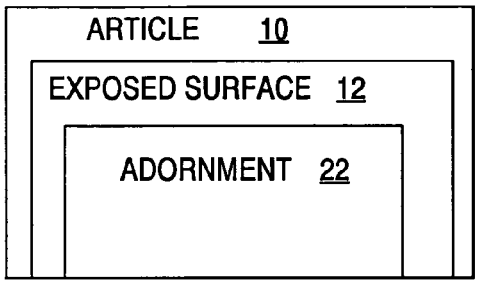
FIG. 2 is a schematic representation of adornment, of the type shown in FIG. 1, that is placed on an exposed surface of the article in FIG. 1.

As explained in greater detail below, and as shown schematically in FIG. 2, the edge 14 and/or the edge 18 define all or part of adornment 22 at the exposed surface 12 of the article 10 that is at least one of: a) a word; b) a logo; c) a letter; d) a depiction of: i) a person; ii) a place; or iii) a thing; and e) an object associated with: i) a person; ii) a place; iii) a thing; or iv) an event.

Figure 3:
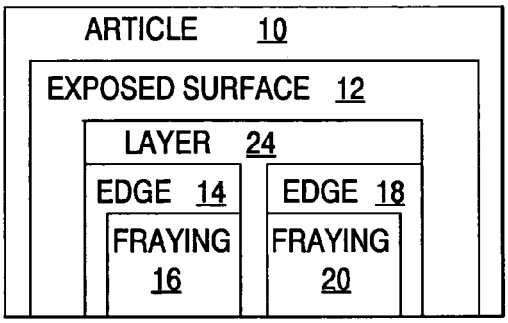
FIG. 3 is a schematic representation of the article in FIG. 1 wherein the frayed edges are defined on a single layer.

As shown in FIG. 3, the edges 14, 18, with the fraying 16, 20 thereon, may be formed on the same layer 24 that defines part or all of the exposed surface 12 of the article 10.

Figure 4:
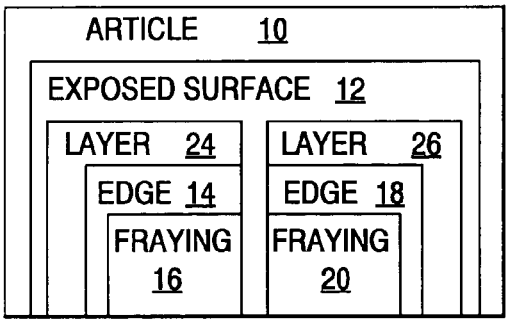
FIG. 4 is a view as in FIG. 3 wherein the edges are defined on separate layers.

Alternatively, as shown in FIG. 4, the edge 14, with the fraying 16 thereon, may be formed on the layer 24, with the edge 18, with the fraying 20 thereon, formed on a separate layer 26 that over-/underlies the layer 24 on the article 10 so that the fraying 16, 20 is visible at the exposed surface 12.

As just one example, the layer 26 may be in the form of a patch that is applied over the layer 24. Alternatively, the layer 26 may underlie the layer 24, with the layers 24, 26 potentially made from different types or colors of materials, which allows blending of characteristics of both to produce different desired effects.

Figure 5:
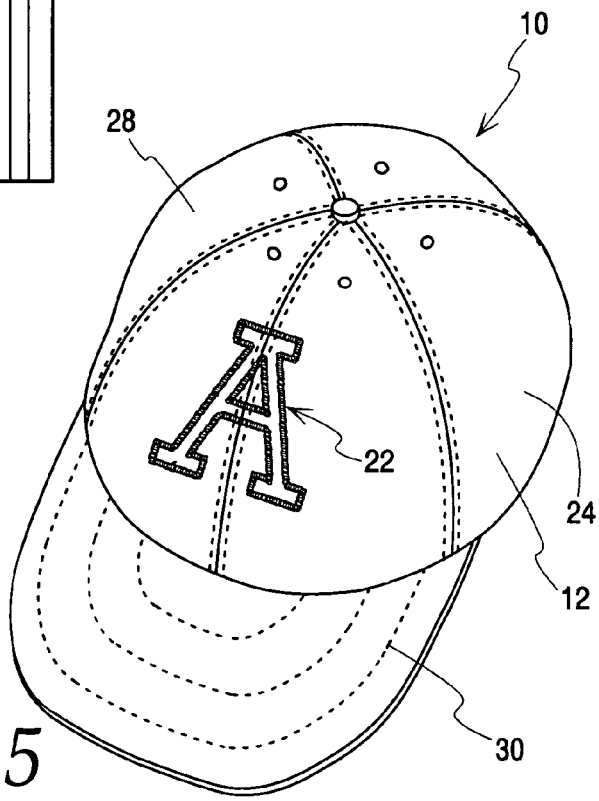
FIG. 5 is a perspective view of one form of article in the form of a baseball-style cap with adornment, according to the invention, on the front thereof.
Figure 6:
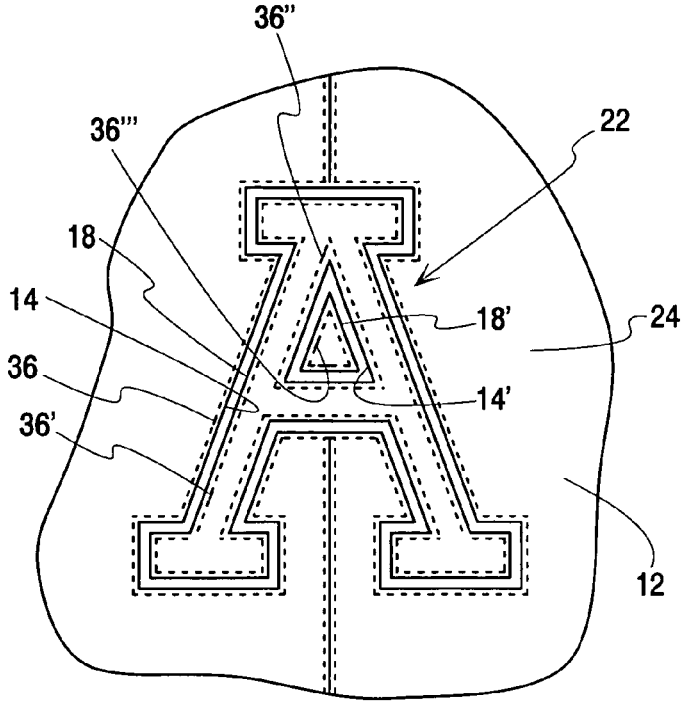
FIG. 6 is an enlarged, fragmentary, elevation view of the front of the cap in FIG. 5 with the ornamentation thereon prior to fraying of edges cut in an exposed layer thereon.
Figure 7:
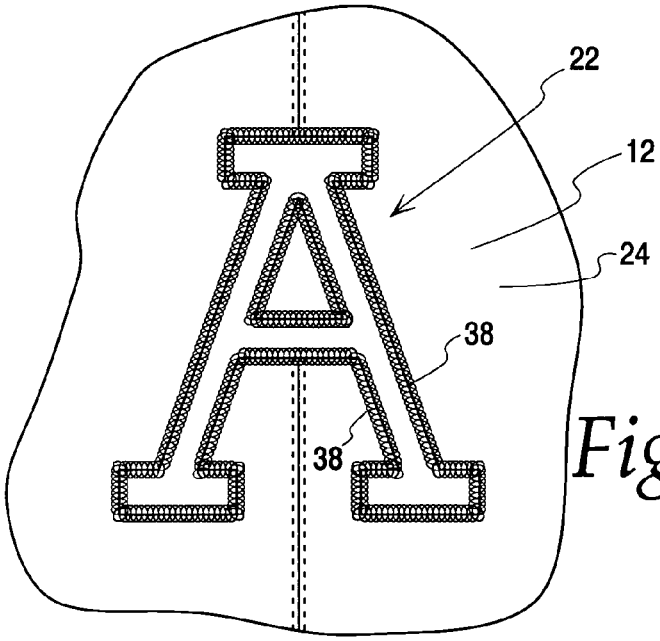
FIG. 7 is a view as in FIG. 6 wherein the edges are frayed.

One specific form of the invention is shown in FIGS. 5-7, with the article 10 in the exemplary form of a baseball-style cap. The cap 10 has an inverted, cup-shaped crown 28 with a forwardly projecting rim/bill 30. The exposed, external surface 12 on the crown 28 is defined by the layer 24. The layer 24 may be a woven cloth material that has a tendency to fray at a cut edge thereon, or any other material that can be treated to produce visible fraying. The layer 24 extends continuously to define a majority of the exposed surface 12 of the crown 28 that is locally altered as hereinafter explained.

The layer 24 is preferably cut to define the edge 14, as seen in FIG. 6. The edge 14 is spaced from the edge 18. The edges 14, 18 bound predetermined, identifiable and recognizable shapes and in this case bound the outline of a logo in the form of the letter "A". The edge 18 defines the outline/periphery of the letter "A", with the edge 14 coextensive with the edge 18 and extending in spaced relationship fully around the periphery of the "A". An edge 14' defines a cutout in the "A", with an edge 18' surrounding a corresponding shape therewithin.

All of the edges 14, 14', 18, 18' may be defined by forming voids/spaces in the same layer 24. Alternatively, the layer 26 may be formed in the "A" shape and applied as a separate element/patch on the layer 24. The surrounding cut 14 may be formed in the layer 24 or on a separate element.

Figure 8:
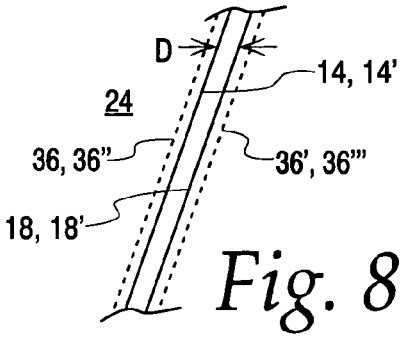
FIG. 8 is an enlarged, fragmentary, elevation view of a portion of the ornamentation in FIGS. 5-7 in the state shown in FIG. 6.
Figure 9:
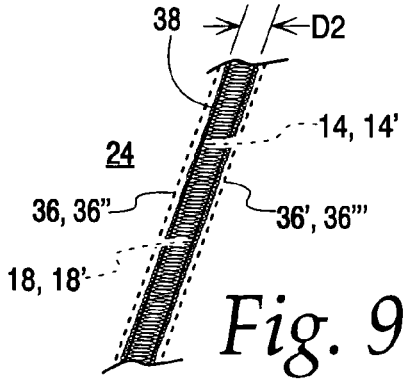
FIG. 9 is a view as in FIG. 8 wherein the edges are frayed, as in FIG. 7.

As shown in FIGS. 8 and 9, over the full extent of the adornment 22, the edges 14, 14' and 18, 18' are spaced from each other a substantially uniform equal distance D, although this is not a requirement. The distance D may be very insignificant, as when the adjacent edges 14, 14' and 18, 18' are formed by a cut with no material removed, or may be on the order of as much as two inches. More preferably, the distance D is in the range of 0 to ½ inch to produce a desired visual effect.

The layer 24 is altered adjacent to the edges 14, 14', 18, 18', in this case by providing lines of stitching 36, 36' at a location spaced a controlled distance from the edges 14, 14', 18, 18'. The line of stitching 36 controls fraying at the edge 14, with the line of stitching 36' controlling fraying at the edge 18. That is, the fraying generally may extend up to, but not appreciably beyond, the lines of stitching 36, 36'. Lines of stitching 36", 36'" are similarly formed adjacent to the edges 14', 18'.

The fraying may be induced by any of a number of different means, and typically by washing the cap 10. Regardless of the means employed, the fraying is generally caused by frictional forces at the edges 14, 14', 18, 18', which causes individual strands 38 to separate and potentially bunch up or coil. Cooperatively, the strands from each edge 14, 14', 18, 18' potentially produce a fluffy, cotton-like appearance, of course depending upon the nature of the material in the layer 34, their length, the treating method, etc.

FIG. 6 shows the adornment 22 in a state preparatory to inducing the fraying. That is, the layer 34 is altered by the lines of stitching 36, 36', 36", 36'". By inducing the fraying, the strands 38 from the edges 14, 14', 18, 18' bunch up/coil and produce the fluffed appearance, as shown in FIG. 7.

The relationship between the edges 14, 14', 18, 18' contributes to the overall appearance of the adornment 22. As noted above, a cut may be defined in the layer 24 so as to define the edges 14, 14'; 18, 18' with no spacing therebetween. Alternatively, the layer 24 can be cut out to produce a space/void with the width D (FIG. 8) between the edges 14, 14'; 18, 18'. The gap width D may be such that there is no intermingling of the strands 38 from the adjacent edges 14, 14'; 18, 18'. More preferably, the gap width D is such that the strands 38 on the fraying on the spaced edges 14, 14'; 18, 18' are in contact with each other. Preferably, there is substantial intermingling of the strands 38 on the adjacent edges 14, 14'; 18, 18' to produce fullness to the cotton-like appearance. However, the gap width D may be such that after fraying is induced, the strands 38 in the fraying at the spaced edges 14, 14'; 18, 18' remain spaced by as much as one inch or more.

The width of the combined fraying produced by the strands 38, as indicated by the dimension D2 in FIG. 9, is dictated by the width D of any gap and the length and nature of the strands 38, as well as their response to treatment. The width dimension D2 may be equal to, or slightly less than or greater than, the width dimension between the lines of stitching 35, 35"; 35', 36'". A combined width D2 of the fraying may be on the order of one half inch or less, although this is not a requirement. The fraying defines an outline/border that highlights a shape on the exposed surface 12 that is surrounded by the edges 14, 14', 18, 18' in the predetermined shape, as seen in FIGS. 5 and 7. This width dimension D2 may be on the order of ⅛ of an inch to produce a sharp bordering line following the predetermined shape.

Typically, the fraying is controlled so that strands 38 having a length on the order of one half inch, or less, are produced. This dimension may change depending upon the material utilized. Of course, this again can be varied depending upon the desired look and the spacing, if any, between the edges 14, 14', 18, 18'.

In this embodiment, the adornment 22 is provided at the front region of the cap 10. However, the adornment 22 could be placed elsewhere on the crown 28, upon the rim/bill 30, or on both of these components. While the edges 14, 14', 18, 18' are shown continuously to surround a space on the exposed surface 32, it is not necessary that the edges 14, 14', 18, 18' be continuous, either alone or collectively.

Figure 10:
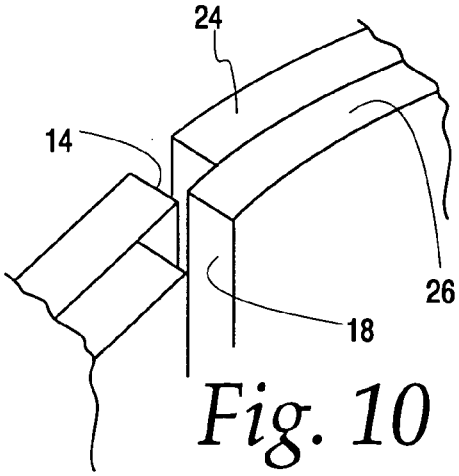
FIG. 10 is a fragmentary, perspective view of two layers in which frayed edges are formed to cooperatively produce the inventive adornment.

As noted above with respect to FIG. 4, the edges 14, 18 may be provided on separate layers 24, 26, as seen in greater detail in FIG. 10 wherein there are cuts/cutouts.

Figure 11:
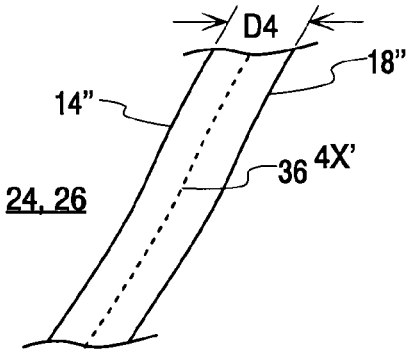
FIG. 11 is a view as in FIG. 8 with a modified form of adornment, wherein two edges to be frayed are contiguous and in between which a line of stitching is provided.
Figure 12:
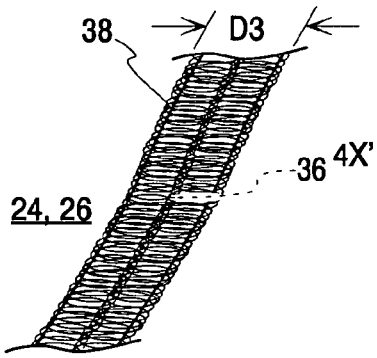
FIG. 12 is a view as in FIG. 11 with the edges frayed.

As shown in FIGS. 11 and 12, a line of stitching $\mathbf{36}^{4x'}$ may be provided between edges 14", 18" on a contiguous portion of a layer of material susceptible to fraying. The spacing of the edges 14", 18" from the line of stitching $\mathbf{36}^{4x'}$ determines generally the length of the strands 38 in the fraying on opposite sides of the line of stitching $\mathbf{36}^{4x'}$. In this embodiment, the strands 38, on opposite sides of the line of stitching $\mathbf{36}^{4x'}$, are intermingled to produce an overall width D3 that is slightly greater than the width dimension D4 between the edges 14", 18". This is not a requirement, as a visible space may remain detectable between strands 38 associated with the spaced edges 14", 18".

Figure 13:
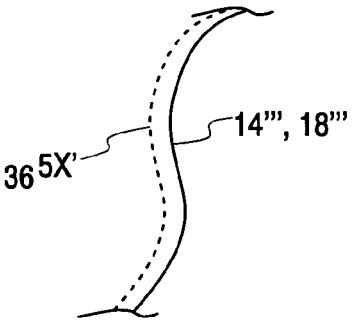
FIG. 13 is a view as in FIGS. 8 and 9 with a modified form of adornment having a single edge before fraying.
Figure 14:
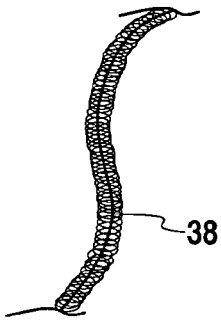
FIG. 14 is a view as in FIG. 13 after fraying.

As noted above, and as shown in FIGS. 13 and 14, the controlled fraying can be produced at a single edge 14'", 18'". A line of stitching $\mathbf{36}^{5x'}$ controls the fraying which is shown for the strands 38 in FIG. 14.

The invention contemplates many other variations using the basic concepts described above. As an example, a single one of the edges may be defined by a single layer alone, or by multiple layers, and by utilizing an alternating arrangement of fraying from each of the layers along at least a part of the length of the edge.

As another example, as an alternative to using stitching to control fraying, other alterations may be made to the layers, such as the application of an adhesive, stapling, etc.

Figure 15:
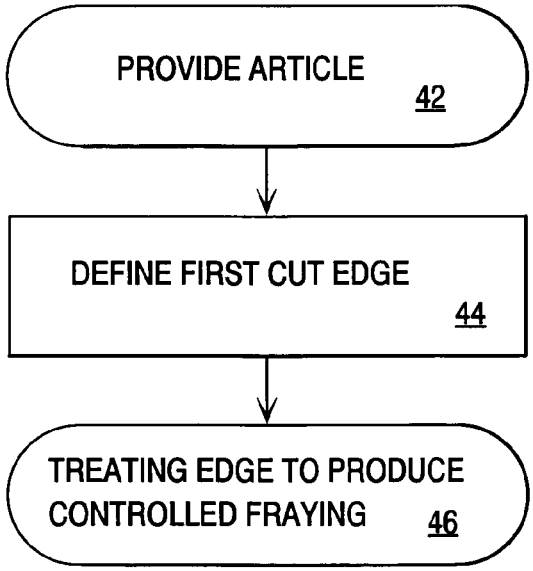
FIG. 15 is a flow diagram representation of a method of producing adornment on an article, according to the present invention.

With the invention as described above, ornamentation on an article can be produced in one exemplary manner, as shown in flow diagram form in FIG. 15. More particularly, as shown at block 42, an article is provided. At least a first edge is defined in a predetermined shape on a material that has a tendency to fray, as shown at block 44, as by cutting. The material in which the first cut edge is defined is treated to produce controlled fraying at the first edge, as shown at block 46.

The foregoing disclosure of specific embodiments is intended to be illustrative of the broad concepts comprehended by the invention.

The invention claimed is:

1. An adorned headwear piece having a crown with an exposed surface, the headwear piece comprising:

a first layer defining a majority of the exposed surface of the crown; and adornment on the first layer that is exposed for viewing, the adornment comprising a first edge on the first layer with a length bounding an outline of a predetermined shape that is defined by the first layer, the first edge defined by a material that has a tendency to fray at the first edge and extending continuously to define the outline and around a space bounded by the outline, the first edge treated to produce visible fraying comprising strands that project into the space, wherein the predetermined shape comprises at least one of: a) a word; b) a logo; c) a letter; d) a depiction of i) a person; ii) a place; or iii) an object; and e) a depiction of an object associated with at least one of: i) a person, ii) a place; and iii) an event, wherein the adornment further comprises a second edge with a length, the second edge defined by a material that has a tendency to fray at the second edge, the fraying on the first and second edges defined by strands, the strands on the first and second edges project towards each other and are intermingled along a substantial extent of the predetermined shape, the first and second edges spaced from each other a substantially uniform equal distance over a substantial extent of the first edge.

2. The adorned headwear piece according to claim 1 wherein the first edge extends to substantially continuously surround the space at the exposed surface.

* * * * *